US006817322B2

(12) United States Patent
Hardin

(10) Patent No.: US 6,817,322 B2
(45) Date of Patent: Nov. 16, 2004

(54) CYLINDER HEAD

(75) Inventor: William J. Hardin, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 114 days.

(21) Appl. No.: 10/232,577

(22) Filed: Sep. 3, 2002

(65) Prior Publication Data

US 2004/0040521 A1 Mar. 4, 2004

(51) Int. Cl.[7] ..... F02F 1/36
(52) U.S. Cl. ..... 123/41.82 R
(58) Field of Search ..... 123/41.82 R

(56) References Cited

U.S. PATENT DOCUMENTS

| | | | | |
|---|---|---|---|---|
| 1,526,744 A | | 2/1925 | Eberle | |
| 2,739,579 A | * | 3/1956 | Marsden et al. | 123/41.82 R |
| 2,858,815 A | * | 11/1958 | Burrows et al. | 123/41.82 R |
| 3,081,755 A | | 3/1963 | Kotlin et al. | 123/41.77 |
| 3,377,996 A | | 4/1968 | Kotlin et al. | 123/41.31 |
| 3,420,215 A | * | 1/1969 | Seifert | 123/41.82 R |
| 4,304,199 A | | 12/1981 | Formia et al. | 123/254 |
| 4,690,104 A | | 9/1987 | Yasukawa | 123/41.32 |
| 5,094,193 A | | 3/1992 | Yoshikawa | 123/41.82 R |
| 5,868,106 A | | 2/1999 | Poropatic et al. | 123/41.82 R |

FOREIGN PATENT DOCUMENTS

| | | |
|---|---|---|
| CH | 69219 | 12/1913 |
| GB | 426093 | 3/1935 |

* cited by examiner

*Primary Examiner*—Noah P. Kamen

(57) ABSTRACT

A cooling chamber for a cylinder head including a floor portion, a ceiling portion, and sidewall portions extending between the floor portion and ceiling portion. The cooling chamber may also include at least one exhaust port conduit extending through the cooling chamber from the floor portion towards the ceiling portion, at least one intake port conduit extending through the cooling chamber from the floor portion towards the ceiling portion, and a well portion. The at least one intake port conduit and the at least one exhaust port conduit may be disposed around the well portion. The cooling chamber may include a plurality of rib formations extending inwardly from the sidewall portions and a plurality of inlets arranged around a periphery of the cooling chamber. The rib formations are configured to deflect the coolant flow around the conduits towards the well portion.

21 Claims, 5 Drawing Sheets

CYLINDER HEAD

TECHNICAL FIELD

The present invention generally relates to a cylinder head for an internal combustion engine, and more particularly relates to a cylinder head including rib formations.

BACKGROUND

A typical cylinder head for an internal combustion engine is formed by a casting process and has an inner wall, an outer wall, and sidewalls. The cylinder head may have three regions, typically referred to as the upper deck, the middle deck, and the lower deck. The lower deck is typically mounted to an engine block adjacent one or more combustion chambers. The cylinder head is designed to control gaseous flow from the intake manifolds to the combustion chamber and from the combustion chamber to the exhaust manifolds. Generally, the gaseous flow passes through the lower deck. If required, the cylinder head may support a firing mechanism for each combustion chamber of the internal combustion engine. Because each of these requires openings to the combustion chamber through the lower deck, there are localized areas subject to increased levels of heat and stresses.

As a result of the operation of the internal combustion engine, the combustion chamber(s), cylinder head(s), piston (s), and other areas of the engine block are exposed to high levels of heat. This heat creates high thermal gradients from the heat of the combustion process, the cooling system, and other systems of the internal engine. These high thermal gradients create localized stress regions and potential hot spots within the lower deck of the cylinder head that can alter the alignment of the firing mechanism and other components in the internal combustion engine, thereby causing the internal combustion engine to operate inefficiently.

Generally, coolant flow paths may be provided in the cylinder head to draw heat from the hot spots. These flow paths assist in maintaining the cylinder head near a uniform temperature and reduces the likelihood of fracturing as the cylinder head temperature fluctuates. U.S. Pat. No. 4,690,104 ("Yasukawa") describes one such type of cylinder head. Yasukawa is directed to a cylinder head that provides plugs to speed up coolant flow in regions of large cross-sectional areas. In addition, Yasukawa provides several fins located on boss portions for securing the cylinder head to the engine block, as wells as on cylindrical walls that connect the intake and exhaust valves to the combustion chamber.

One drawback to Yasukawa is that neither the plugs nor the fins provide additional rigidity to the inner wall of the cylinder head. As a result, the inner wall experiences problems with stiffness and potential failure because of the cyclic loadings created by combustion of fuel in the combustion chambers.

The present invention solves one or more of the problems described above associated with known cylinder heads.

SUMMARY OF THE INVENTION

One aspect of the present invention is directed to a cooling chamber for a cylinder head. The cooling chamber may include a floor portion, a ceiling portion, and sidewall portions extending between the floor portion and ceiling portion. The cooling chamber may also include at least one exhaust port conduit extending through the cooling chamber from the floor portion towards the ceiling portion, at least one intake port conduit extending through the cooling chamber from the floor portion towards the ceiling portion, and a well portion. The at least one intake port conduit and the at least one exhaust port conduit may be disposed around the well portion. Finally, the cooling chamber may include a plurality of rib formations extending inwardly from the sidewall portions and a plurality of inlets arranged around a periphery of the cooling chamber. The rib formations are configured to deflect the coolant flow around the at least one intake port conduit and the at least one exhaust port conduit towards the well portion.

Another aspect of the present invention is directed at a method of cooling a cylinder head for an internal combustion engine. The cylinder head defining a cooling chamber having a floor portion, a ceiling portion, and sidewall portions extending between the floor portion and ceiling portion. The method includes introducing a coolant around a periphery of the cooling chamber through a plurality of inlets arranged at the periphery of the cooling chamber and directing the coolant flow from the inlets in the cooling chamber towards a well portion. The directing is regularly obstructing coolant flow at a predetermined location adjacent the side wall portions.

BRIEF DESCRIPTION OF THE DRAWINGS

The accompanying drawings, which are incorporated in and constitute a part of this specification, illustrate one exemplary embodiment of the invention and together with the description, serve to explain the principles of the invention. In the drawings.

DETAILED DESCRIPTION

Reference will now be made in detail to one exemplary embodiment of the invention, which is illustrated in the accompanying drawings. Wherever possible, the same reference numbers will be used throughout the drawings to refer to the same or like parts.

Figure 1:
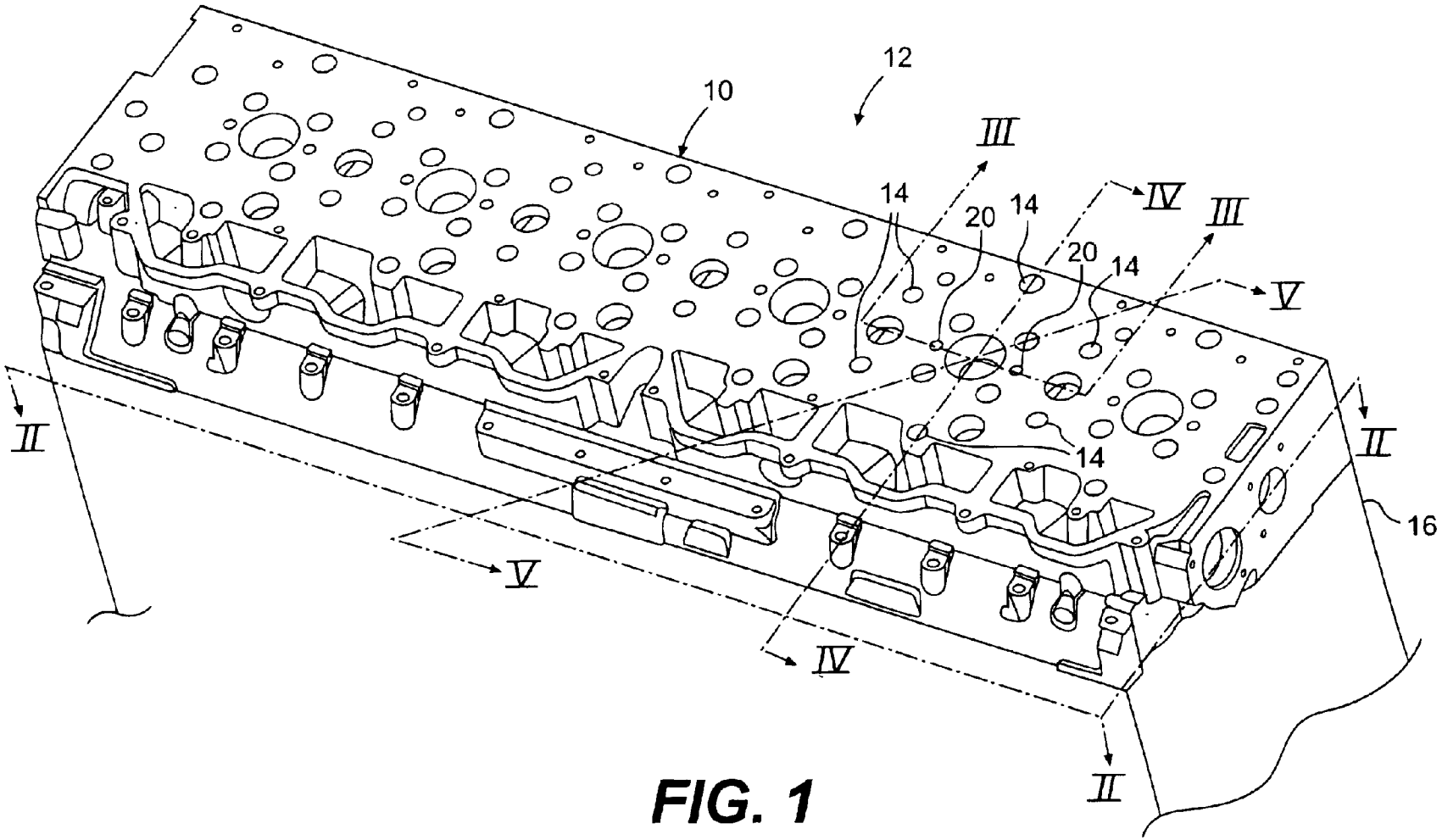
FIG. 1 is a perspective view of a cylinder head for an internal combustion engine.

FIG. 1 shows an internal combustion engine 12 having a cylinder head 10 coupled to an engine block 16. The engine block 16 defines a plurality of cylinders that define combustion chambers and contain pistons (not shown) of the internal combustion engine 12. The internal combustion engine 12 may utilize, for example, an "in-line" cylinder arrangement, as shown, or a "V" cylinder arrangement. In this application, bolts (not shown) pass through a plurality of bolt holes 14 in the cylinder head 10 and connect with the engine block 16.

The cylinder head 10 may be formed from cast iron, aluminum, or other suitable material. The cylinder head 10 may be formed by, for example, a casting process such as sand casting. While cylinder head 10 is shown as a "slab cylinder head" for a six cylinder engine, it should be understood that the cylinder head may be modified for other cylinder arrangements including an individual cylinder head, known as a "single cylinder head."

Figure 2:
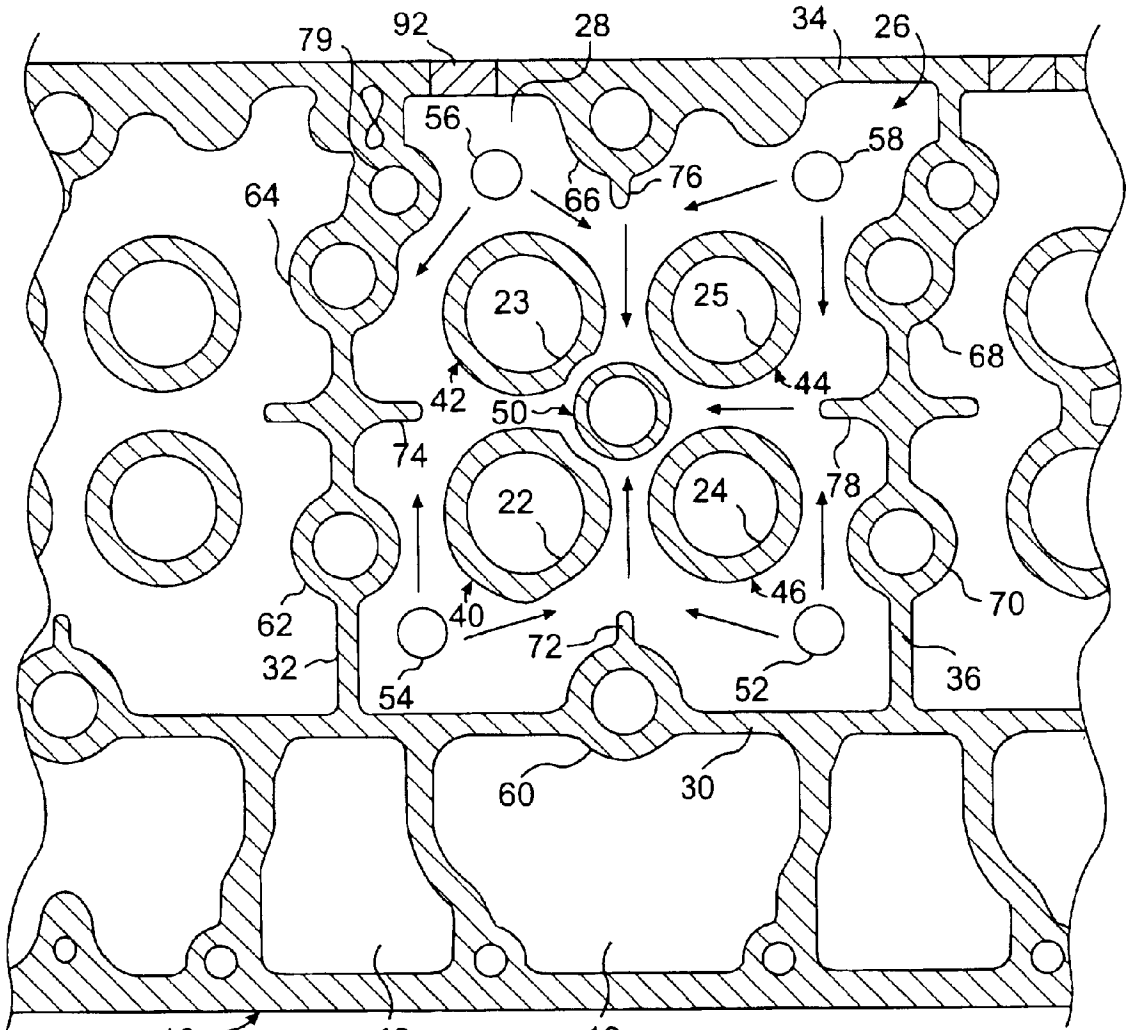
FIG. 2 is a partial section plan view taken along section plane II—II of FIG. 1.

With reference to FIGS. 1 and 2, push rod ports 18 are formed in the cylinder head to allow for movement of the push rods (not shown) of the internal combustion engine 12. Also shown in a surface of the cylinder head 10 are a plurality of bridge dowel holes 20 (shown in FIG. 1), which are configured to support bridges, which in turn support the valves (not shown) used to open and close intake ports 22, 23 and exhaust ports 24, 25 associated with each cylinder of the internal combustion engine 12. It should be understood by one of ordinary skill in the art that the invention is not limited to the embodiment shown and that the invention may be utilized with internal combustion engines having overhead cams or a two valve head rather than a four valve head.

A cooling chamber 26 associated with each cylinder of the internal combustion engine 12, as best seen in FIG. 2, is defined by a floor portion 28 and sidewall portions 30, 32, 34, 36. The cooling chamber 26 also is defined by a ceiling portion 38 (shown in FIGS. 3 and 4). The sidewall portions 30, 32, 34, 36 extend from the floor portion 28 to the ceiling portion 38.

A pair of intake port conduits 40, 42 extend from the floor portion 28 through the cooling chamber 26 toward the ceiling portion 38. A pair of exhaust port conduits 44, 46 also extend from the floor portion 28 through the cooling chamber 26 toward the ceiling portion 38. The intake port conduits 40, 42, and exhaust port conduits 44, 46 allow for air to flow through intake ports 22, 23 prior to combustion and allow for exhaust gases to flow out of exhaust ports 24, 25 after combustion, respectively.

A well portion 48 (shown in FIGS. 3–5) extends through the cylinder head 10 into the cooling chamber 26. A receptacle 50 is inserted into the well 48 and is configured to support a firing mechanism (not shown), such as, for example, a fuel injector or spark plug. The receptacle 50 is located substantially in the center of the cooling chamber 26, and the pair of intake port conduits 40, 42 and exhaust port conduits 44, 46 are arranged substantially symmetrically thereabout. As an alternative, the receptacle 50 could be located in any nonsymmetrical arrangement of conduits 40, 42, 44, 46. The receptacle 50 may extend from the floor portion 28, through the cooling chamber 26, towards the ceiling portion 38.

Next to each push rod port 18 is an air inlet port 19 that allows air to flow through the intake ports 22, 23 into the cylinder of the internal combustion engine. In this embodiment, there is only one air inlet port 19 associated with each cylinder, but it is understood that additional air inlet ports can be utilized and the location of the inlet port(s) can be modified without departing from the scope of the invention.

A plurality of inlets 52, 54, 56, 58 are formed in floor portion 28 of the cooling chamber 26. These inlets 52, 54, 56, 58 are aligned with passages (not shown) in the engine block 16 and allow for coolant to flow from the engine block 16 to the cooling chamber 26 of the cylinder head 10. As shown in FIG. 2, the cooling chamber 26 is substantially rectangular and each of the inlets 52, 54, 56, 58 is located in a respective corner of the cooling chamber. It is understood that the cooling chamber is not limited to rectangular shapes and that other shapes may work equally well. In addition, it is understood that six inlets or any other suitable number of inlets may be provided without departing from the scope of the invention.

A plurality of bosses 60, 62, 64, 66, 68, 70 are formed in the sidewall portions 30, 32, 34, 36 of cooling chamber 26. These bosses 60, 62, 64, 66, 68, 70 are provided at bolt hole locations 14 to strengthen the respective sidewall portions, but, alternatively, the bosses could be located at other locations. In this embodiment, the bosses form a substantially symmetrical pattern above each cylinder to provide for substantially even force distribution. Boss 60 is formed in sidewall portion 30, bosses 62, 64, are formed in sidewall portion 32, boss 66 is formed in sidewall portion 34 opposite sidewall portion 30, and bosses 68, 70 are formed in sidewall portion 36 opposite sidewall portion 32.

A plurality of gussets or rib formations 72, 74, 76, 78 extend from the sidewall portions 30, 32, 34, 36 into the cooling chamber 26 towards the well portion 48. Rib formations 74 and 78 are located on sidewall portions 32, 36 between bosses 62, 64, and 68, 70, respectively. These rib formations 74, 78 increase the strength of sidewall portions 32, 36 between the bosses 62, 64, and 68, 70, respectively. The other rib formations 72, 76 are formed on the bosses 60, 66, respectively. In addition to strengthening the sidewalls, the rib formations 72, 74, 76, 78 may also serve to direct coolant flow through the cooling chamber 26 as described below.

An oil return hole 79 associated with each individual cylinder for the internal combustion engine 12 is provided in the cylinder head 10 and extends through one of the sidewall portions and is connected to a passage (not shown) in the engine block 16.

Figure 4:
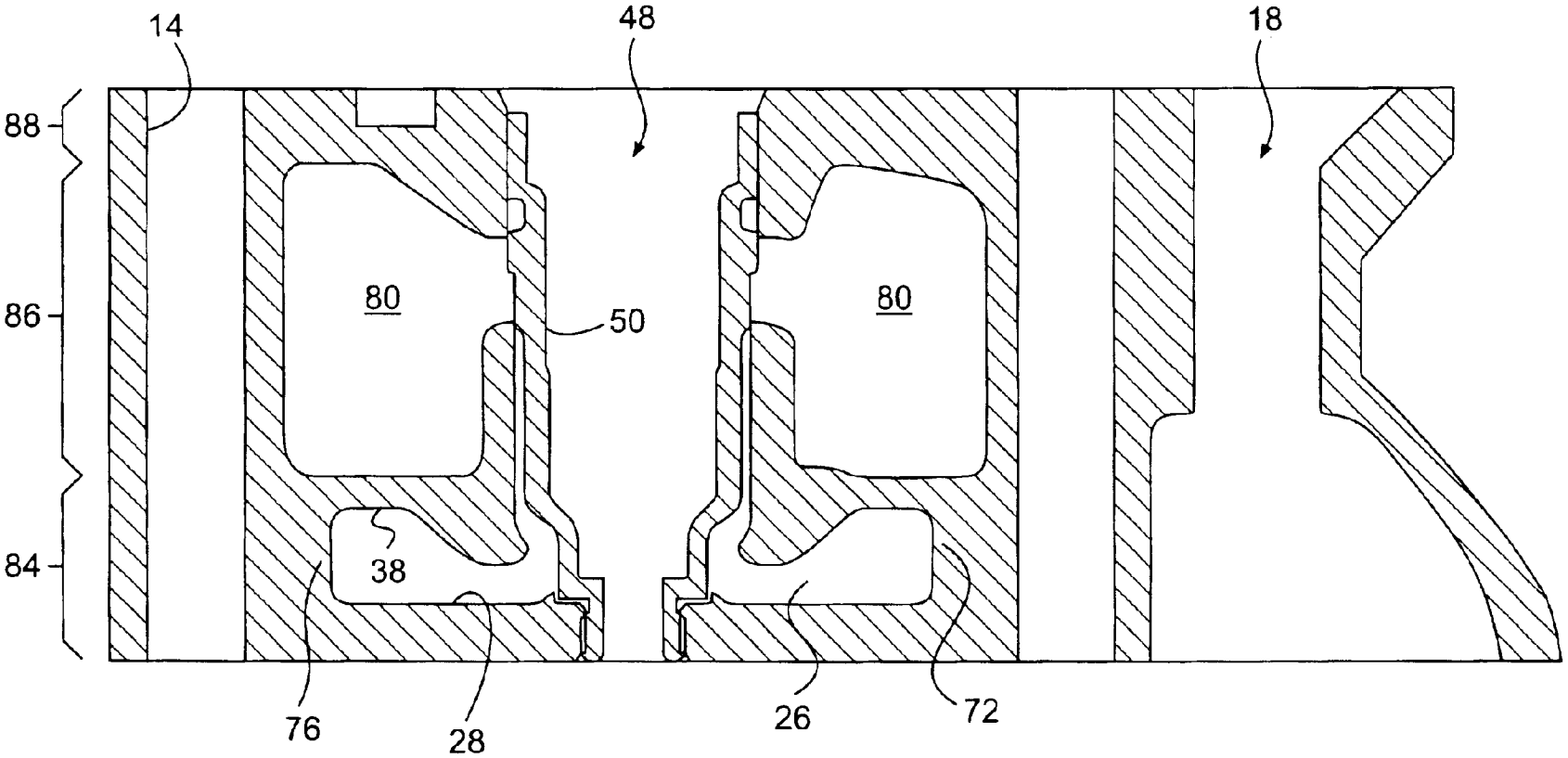
FIG. 4 is an elevation section view taken along section line IV—IV of FIG. 1.
Figure 5:
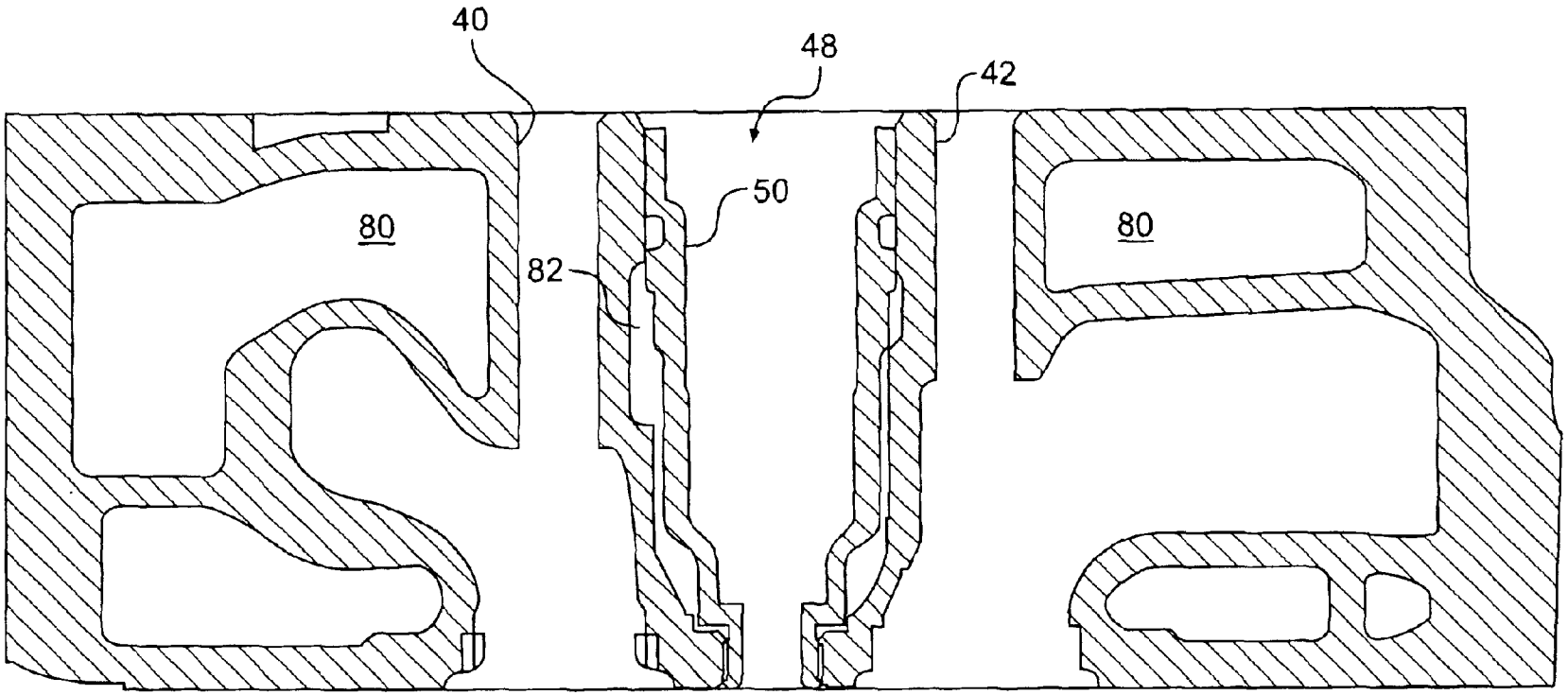
FIG. 5. is an elevation section view taken along section line V—V of FIG. 1.

The cylinder head 10 includes several different regions or decks, as depicted in FIG. 4. Lower deck 84 generally is the deck closest to the engine block and, therefore, carries most of the loadings imposed on the cylinder head 10 during operation. Middle deck 86 generally includes an upper cooling chamber 80 for further cooling of exhaust gases. The upper deck 88 generally carries the support for the intake and exhaust valves. The upper cooling chamber 80 may cool the middle deck 86 and upper deck 88 of the cylinder head 10. An outlet 82 (shown in FIG. 5) for the cooling chamber 26 is defined by the well portion 48 and the receptacle 50. The outlet 82 opens into the upper cooling chamber 80 and allows for coolant to flow from cooling chamber 26 into the upper cooling chamber 80.

Figure 3:
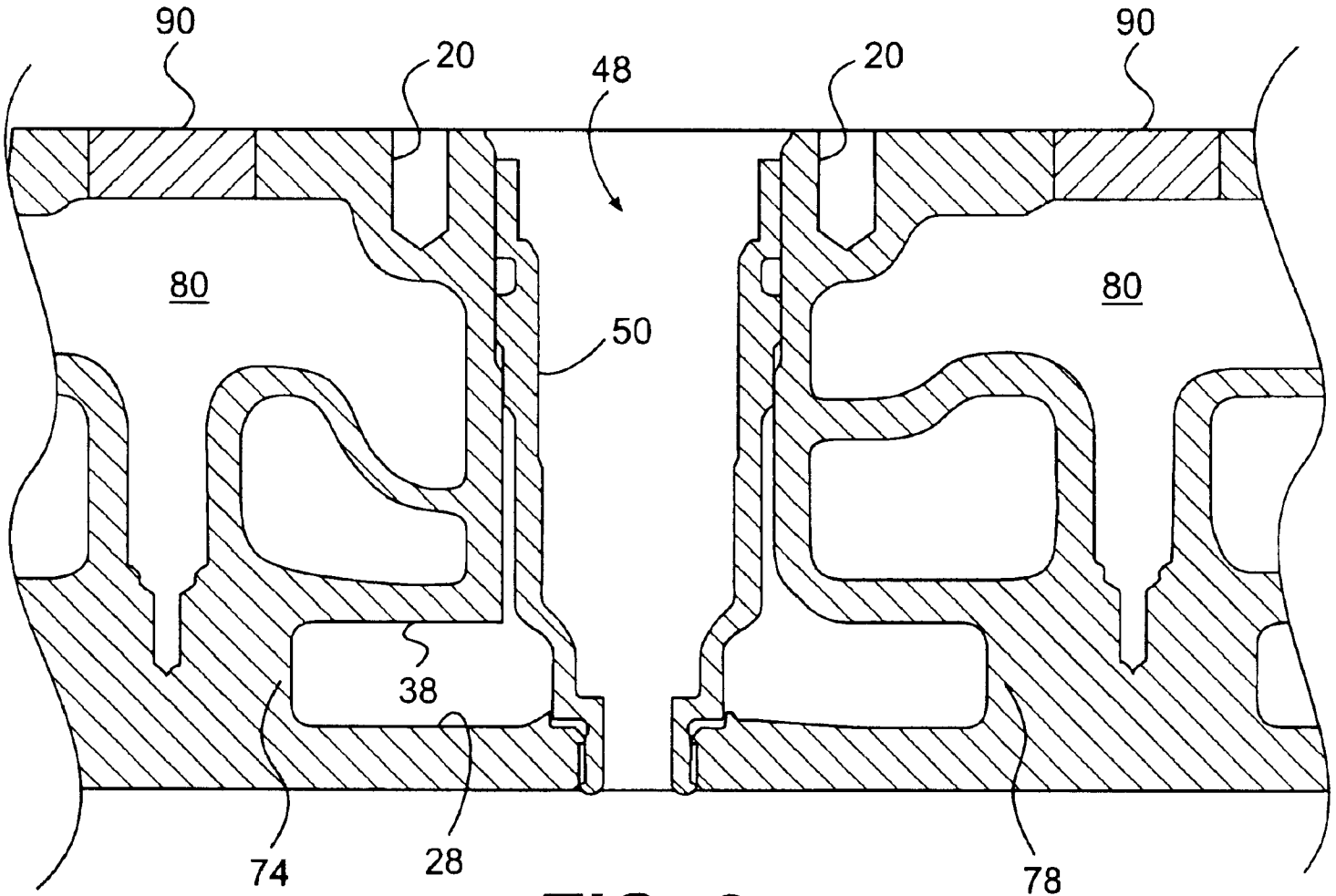
FIG. 3 is an elevation section view taken along section line III—III of FIG. 1.

FIGS. 3 and 4 show that each of the rib portions 72, 74, 76, 78 extends from the floor portion 28 to the ceiling portion 38 of cooling chamber 26. In this embodiment, each rib formation is 20 mm high and the combined height of the lower deck 84, middle deck 86, and upper deck 88 of the cylinder head 10 is 120 mm, although other heights may be used.

Because the cylinder head 10 is typically cast as a unitary piece, a plurality of plugs 90 (shown in FIG. 3), 92 (shown in FIG. 2) are used to seal the upper cooling chamber 80 and the cooling chamber 26, respectively. It is understood that the number or location of the plugs may be modified without departing from the scope of the invention.

Industrial Applicability

During operation of the internal combustion engine 12, the lower deck 84 of the cylinder head 10 experiences high stress loads and localized hot spots above and near each combustion chamber. This is caused by the combustion of fuel in the cylinder and the resultant high pressure driving the piston in the cylinder. Furthermore, the exhaust port conduits 44, 46 are typically subject to high heat due to the exit of the exhaust gases after combustion.

By providing a plurality of rib formations 72, 74, 76, 78 symmetrically arranged above each cylinder on the sidewall portions 30, 32, 34, 36, it is possible to increase the stiffness of the cylinder head 10. The resultant stiffness of the cylinder head 10 improves the operational life of the cylinder head 10 and also assists in preventing misalignment of the firing mechanism due to pressure variants in the cylinder.

In addition, as coolant flows from the engine block 16 into the cooling chamber 26 through the inlets 52, 54, 56, 58, the rib formations 72, 74, 76, 78 direct the coolant flow and increase the localized flow rate of the coolant, thereby resulting in hot spots being cooled more quickly. The rib formations 72, 74, 76, 78 also increase the turbulence of the coolant flow thereby withdrawing additional heat from the hot spots. As most clearly shown in FIG. 2, by having the inlets 52, 54, 56, 58 arranged around the periphery of the cooling chamber, the coolant flow, as indicated by the arrows, from the inlets is deflected by the rib formations 72, 74, 76, 78 about the pair of intake port conduits 40, 42 and exhaust port conduits 44, 46 towards the well portion 48 and receptacle 50. This allows the coolant to more effectively remove heat from the floor portion 28 of the cooling chamber 26 and exhaust port conduits 44, 46.

Once the coolant reaches the receptacle 50, it flows out of the cooling chamber 26 through outlet 82. The coolant then flows into the upper cooling chamber 80 and eventually exits the cylinder head 10. This allows for further cooling of the exhaust port conduits 44, 46 and overall cooling of the cylinder head 10.

As seen in FIG. 2, more than one cooling chamber 26 may be included in the cylinder head 10. In this arrangement, each cooling chamber 26 shares at least one common sidewall portion and coolant flow is provided separately to each cooling chamber 26. However, each cooling chamber 26 does not necessarily need to share a common sidewall portion.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cooling chamber for a cylinder head, comprising:

a floor portion;

a ceiling portion;

sidewall portions extending between the floor portion and the ceiling portion;

at least one exhaust port conduit extending through the cooling chamber from the floor portion towards the ceiling portion;

at least one intake port conduit extending through the cooling chamber from the floor portion towards the ceiling portion;

a well portion, the at least one intake port conduit and the at least one exhaust port conduit being disposed around the well portion;

a plurality of rib formations extending inwardly from the sidewall portions, each of the plurality of rib formations being disposed at a midpoint between the at least one intake port conduit and the at least one exhaust port conduit; and a plurality of inlets defined by and arranged around a periphery of the cooling chamber, wherein at least one of the plurality of rib formations is disposed between each of the plurality of inlets, and each of the plurality of rib formations is configured to deflect coolant flow around the at least one intake port conduit and the at least one exhaust port conduit towards the well portion.

2. The cooling chamber according to claim 1, wherein the periphery of the cooling chamber is substantially rectangular.

3. The cooling chamber according to claim 1, further including a plurality of bosses formed in the sidewall portions of the cooling chamber, each of the plurality of bosses being configured to receive a bolt for connecting the cylinder head with an engine block.

4. The cooling chamber according to claim 3, wherein at least one of the plurality of bosses includes at least one of the plurality of rib formations.

5. The cooling chamber according to claim 3, wherein the sidewall portions include two opposing sidewall portions, each having two of the plurality of bosses.

6. The cooling chamber according to claim 5, wherein each sidewall portion of the two opposing sidewall portions further includes one of the plurality of rib formations located between the two of the plurality of bosses.

7. The cooling chamber according to claim 1, wherein the plurality of rib formations extends through the cooling chamber from the floor portion to the ceiling portion.

8. A cylinder head adapted for use with a multi-cylinder internal combustion engine, comprising:

a plurality of cooling chambers according to claim 1, wherein each of the plurality of cooling chambers is configured to be adjacent a cylinder of the multi-cylinder internal combustion engine.

9. The cylinder head according to claim 8, further including a plurality of bosses formed in the sidewall portions of each of the plurality of cooling chambers, each of the plurality of bosses being configured to receive a bolt for connecting the cylinder head with the multi-cylinder internal combustion engine, wherein each of the sidewall portions common to two adjacent cooling chambers of the plurality of cooling chambers includes two bosses of the plurality of bosses.

10. The cylinder head according to claim 9, wherein one of the plurality of rib formations of each of the plurality of cooling chambers is formed between the two bosses of the plurality of bosses.

11. The cooling chamber of claim 1, wherein at least one of the at least one exhaust port conduit and the at least one intake port conduit is located within a direct path between each of the plurality of inlets and the well portion.

12. A cylinder head adapted for use with an internal combustion engine having at least one cylinder, the cylinder head comprising:

a cooling chamber having a floor portion, a ceiling portion, and sidewall portions extending between the floor portion and ceiling portion;

at least one exhaust port conduit extending through the cooling chamber from the floor portion towards the ceiling portion;

at least one intake port conduit extending through the cooling chamber from the floor portion towards the ceiling portion;

a well portion substantially in the center of the cooling chamber and the at least one intake port conduit and the at least one exhaust port conduit are arranged substantially symmetrically about the well portion;

a plurality of rib formations extending inwardly from the sidewall portions at a midpoint between the at least one intake port and the at least one exhaust port; and a plurality of inlets defined by and arranged around a periphery of the cooling chamber, wherein at least one of the plurality of rib formations is disposed between each of the plurality of inlets, and each of the plurality of rib formations is configured to deflect coolant flow around the at least one intake port conduit and the at least one exhaust port conduit towards the well portion.

13. The cylinder head according to claim 12, wherein the periphery of the cooling chamber is substantially rectangular.

14. The cylinder head according to claim 12, further including a plurality of bosses formed in the sidewall portions of the cooling chamber, each of the plurality of bosses being configured to receive a bolt for connecting the cylinder head with an engine block.

15. The cylinder head according to claim 14, wherein at least one of the plurality of bosses includes at least one of the plurality of rib formations.

16. The cylinder head according to claim 14, wherein the sidewall portions include two opposing sidewall portions, each having two of the plurality of bosses.

17. The cylinder head according to claim 16, wherein each sidewall portion of the two opposing sidewall portions further includes one of the plurality of rib formations located between the two of the plurality of bosses.

18. The cylinder head according to claim 12, wherein the plurality of rib formations extends through the cooling chamber from the floor portion to the ceiling portion.

19. A method of cooling a cylinder head for an internal combustion engine, the cylinder head defining a cooling chamber having a floor portion, a ceiling portion, and sidewall portions extending between the floor portion and the ceiling portion, the method comprising:

introducing a coolant around a periphery of the cooling chamber through a plurality of inlets arranged at the periphery of the cooling chamber; and directing the coolant flow from the plurality of inlets in the cooling chamber towards a well portion, wherein the directing includes obstructing coolant flow with a plurality of rib formations extending inwardly from the sidewall portions, each of the plurality of rib formations disposed at a midpoint between a plurality of engine port conduits and at least one of the plurality of rib formations disposed between each of the plurality of inlets.

20. The method according to claim 19, wherein said directing includes directing the coolant flow from corners of the cooling chamber towards the well portion.

21. The method according to claim 19, wherein said directing includes directing the coolant flow from a periphery of the cooling chamber towards the center of the cooling chamber.

* * * * *